US007025637B1

(12) United States Patent
Lee

(10) Patent No.: US 7,025,637 B1
(45) Date of Patent: Apr. 11, 2006

(54) MEMORY CARD ADAPTER

(76) Inventor: Yun-Hsiu Lee, P.O. Box No. 6-57, Junghe, Taipei 235 (TW)

( * ) Notice: Subject to any disclaimer, the term of this patent is extended or adjusted under 35 U.S.C. 154(b) by 0 days.

(21) Appl. No.: 11/007,252

(22) Filed: Dec. 9, 2004

(51) Int. Cl.
*H01R 25/00* (2006.01)
*H01R 27/02* (2006.01)
*H01R 31/00* (2006.01)

(52) U.S. Cl. ..... 439/638; 439/946

(58) Field of Classification Search ..... 439/638, 439/945, 946
See application file for complete search history.

(56) References Cited

U.S. PATENT DOCUMENTS 5,653,596 A * 8/1997 Banakis et al. ..... 439/64
6,004,144 A * 12/1999 Yeh et al. ..... 439/76.1
6,058,018 A * 5/2000 Gerrits et al. ..... 361/737
6,115,257 A * 9/2000 Laity ..... 361/737
6,203,378 B1 * 3/2001 Shobara et al. ..... 439/638

* cited by examiner

*Primary Examiner*—Hae Moon Hyeon
(74) *Attorney, Agent, or Firm*—Troxell Law Office, PLLC

(57) ABSTRACT

The present invention primarily comprises a terminal assembly frame and its associated terminal installed at an adequate position inside a casing. The casing consists of an upper and a lower casing, and a plurality of terminal holes are located at the central part of the terminal assembly frame, such that the terminal can directly pass through and be fixed into the terminal holes. Then the terminal assembly frame can be latched and fixed at an adequate position between the upper and lower casing. Accordingly, the conventional necessary engineering of welding a circuit board can be avoided, with the easiness of assembly and maintenance, thereby lowering the manufacturing cost, and improving signal transmission due to direct connection.

4 Claims, 4 Drawing Sheets

MEMORY CARD ADAPTER

BACKGROUND OF THE INVENTION a) Field of the Invention

The present invention relates to a memory card adapter, and more particularly to an adapter mechanism for adapting an MS DUO(Memory Stick Duo) memory card to an MS(Memory Stick) memory card, which can have low impedance and be applied quickly to electronic consumer products.

b) Description of the Prior Art

As the popularity of electronic consumer products using expansion cards, such as notebook computers, digital cameras, mobile phones, and palm computers, with a plurality of various kinds of corresponding expansion cards, and the general requirement of compact size for the consumer electronic products, most expansion cards on the market become smaller as well. However, an adapter card also arises such that old-type products can share with smaller expansion cards. After inserting a smaller expansion card into an adapter card, the adapter card can be directly inserted into an electronic consumer product for use. As shown in FIG. 1, a conventional adapter card a comprises a circuit board a2 with adapting function installed inside a casing a1. A print circuit a21 is installed on the circuit board a2, with one end of the print circuit a21 connected with an electronic consumer product b, while the other end connected with a smaller expansion card c, thereby achieving the function of adapting. However, it is easy to increase unnecessary manufacturing costs due to higher cost of using the print circuit a21, higher impedance of print circuit a21, and the necessity of welding the print circuit a21 onto adequate position of the casing a1.

SUMMARY OF THE INVENTION

The primary object of the present invention is to provide an adapter card to adapt an MS DUO memory card into an MS memory card, with easiness of assembly and maintenance, lower manufacturing cost, and improvement of signal transmission via direct connection.

Accordingly, the present invention comprises primarily a terminal assembly frame and its associated terminals installed at an adequate position inside a casing, consisting of an upper and a lower casing with a plurality of terminal holes in the central part of the terminal assembly frame. The terminals can directly pass through and be fixed into the terminal holes, and then latched into an adequate position of the upper and lower casing.

Accordingly, the terminal assembly frame has a simple structure, and the terminals can be inserted into manually or automatically, without welding, such that the terminals can be quickly installed and fixed into the terminal holes of the terminal assembly frame. Therefore, the memory card adapter structure can be quickly and easily assembled, with fewer compartments necessary for maintenance and convenience of replacement, thereby achieving the purpose of lowering manufacturing cost, and improving signal transmission by extremely low impedance due to directly using good conducting metal as the terminals for adapting.

To enable a further understanding of the said objectives and the technological methods of the invention herein, the brief description of the drawings below is followed by the detailed description of the preferred embodiments.

DETAILED DESCRIPTION OF THE PREFERRED EMBODIMENTS

Figure 1:
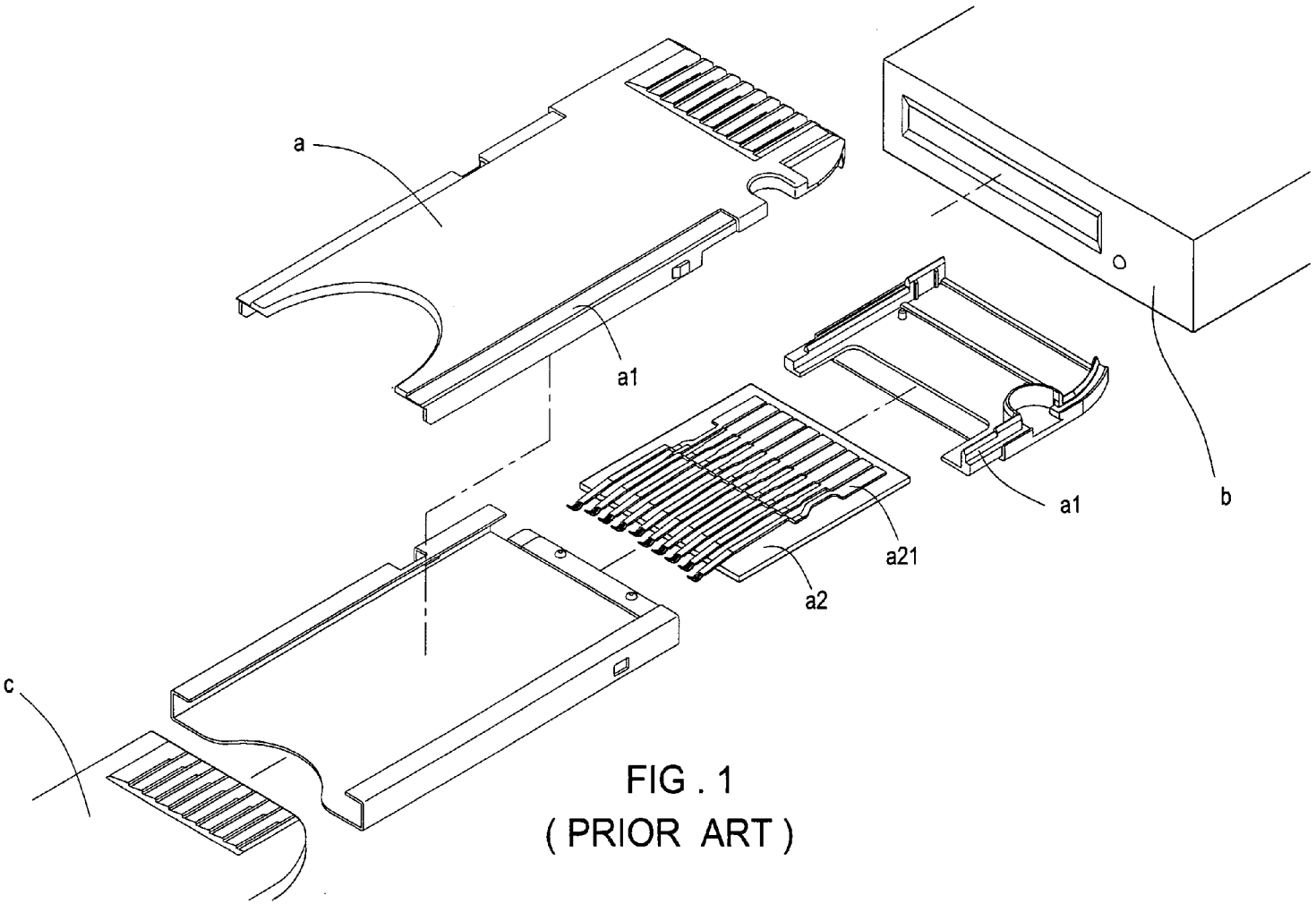
FIG. 1 (PRIOR ART)
FIG. 1 shows an exploded view of a conventional adapter card.
Figure 2:
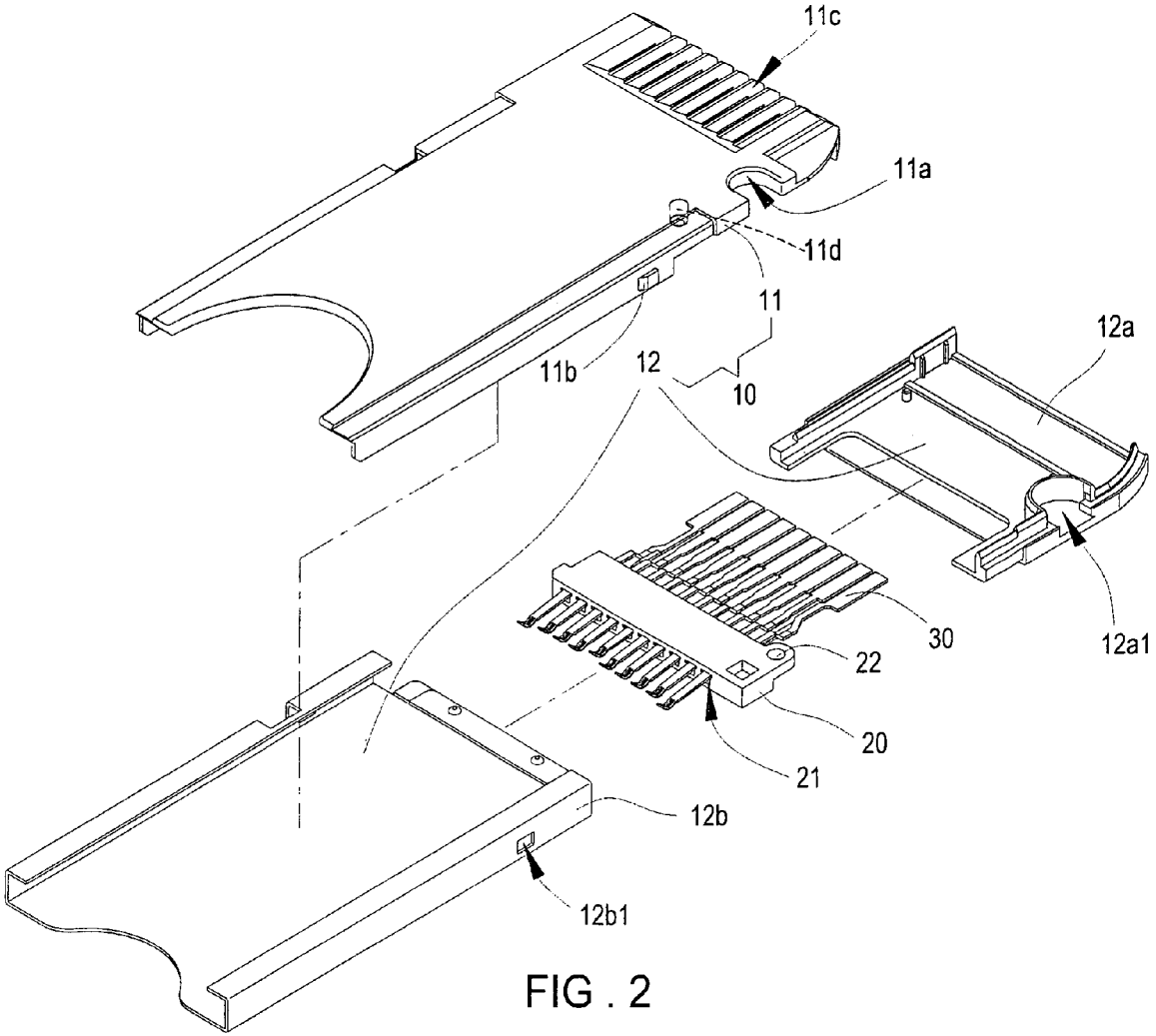
FIG. 2 shows an exploded view of the present invention.
Figure 3:
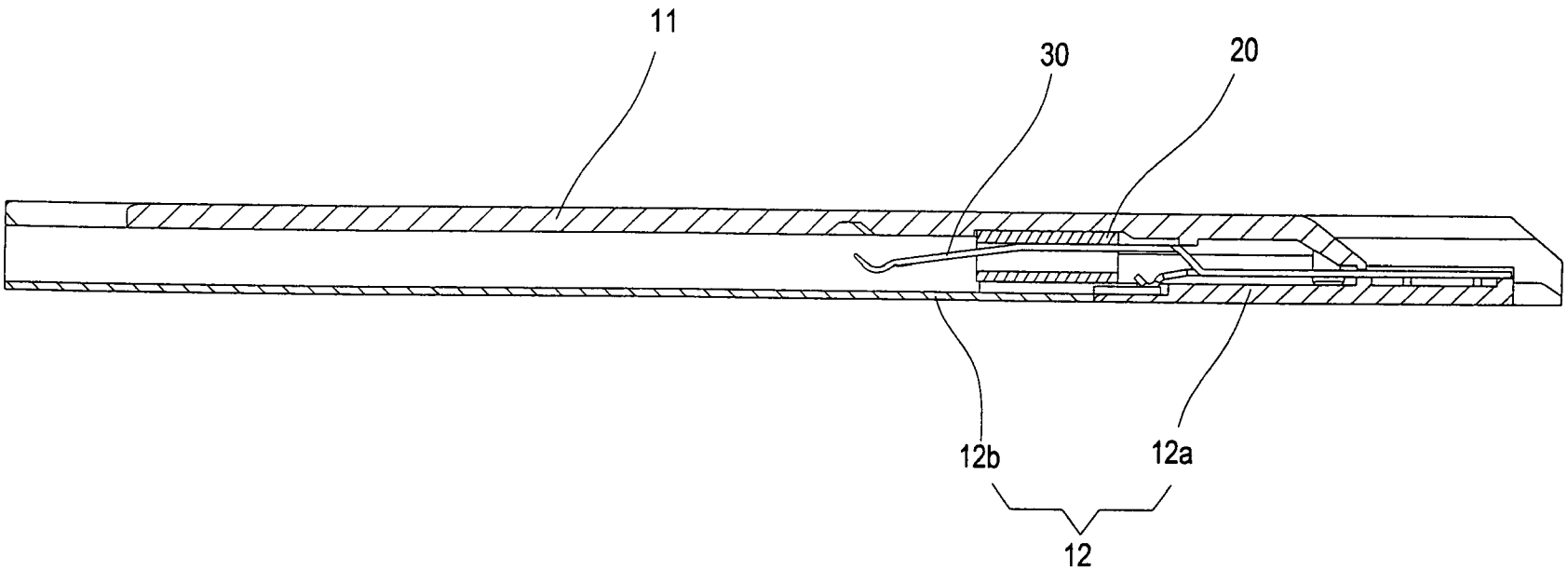
FIG. 3 shows an assembly profile of the present invention.

Referring to FIG. 2 and FIG. 3, the present invention comprises primarily a terminal assembly frame 20 and its associated terminals 30 installed at an adequate position inside a casing 10. The casing 10 consists of an upper casing 11 and a lower casing 12, with latching part 11*b* at two sides of the upper casing 11, and a latching hole 11*a* in front of one side. A plurality of connecting holes 11*c* are located at the top of upper casing 11, and a positioning column 11*d* is installed at an adequate position inside the upper casing 11. The lower casing 12 consists of a front lid 12*a* and a frame 12*b*, wherein the shape of the front lid 12*a* is manufactured to be the same as that of the front end of the upper casing 11, and a latching hole 12*a*1 is also located at one side corresponding to the latching hole 11*a* of the upper casing 11. When emplacing the front lid 12*a* in front of the frame 12*b*, the front lid 12*a* and the frame 12*b* can be fixed together via latching button holes 12*b*1 at two sides of the frame 12*b* with the latching part 11*b* of the upper casing 11. A plurality of terminal holes 21 are located at the central part of the terminal assembly frame 20 such that the terminal 30 can directly pass through and be fixed into the terminal holes 21. A positioning hole 22 is located at one side of the terminal assembly frame 20 to serve as positioning purpose when latching the terminal assembly frame 20 with the upper and lower casing 11, 12.

Figure 4:
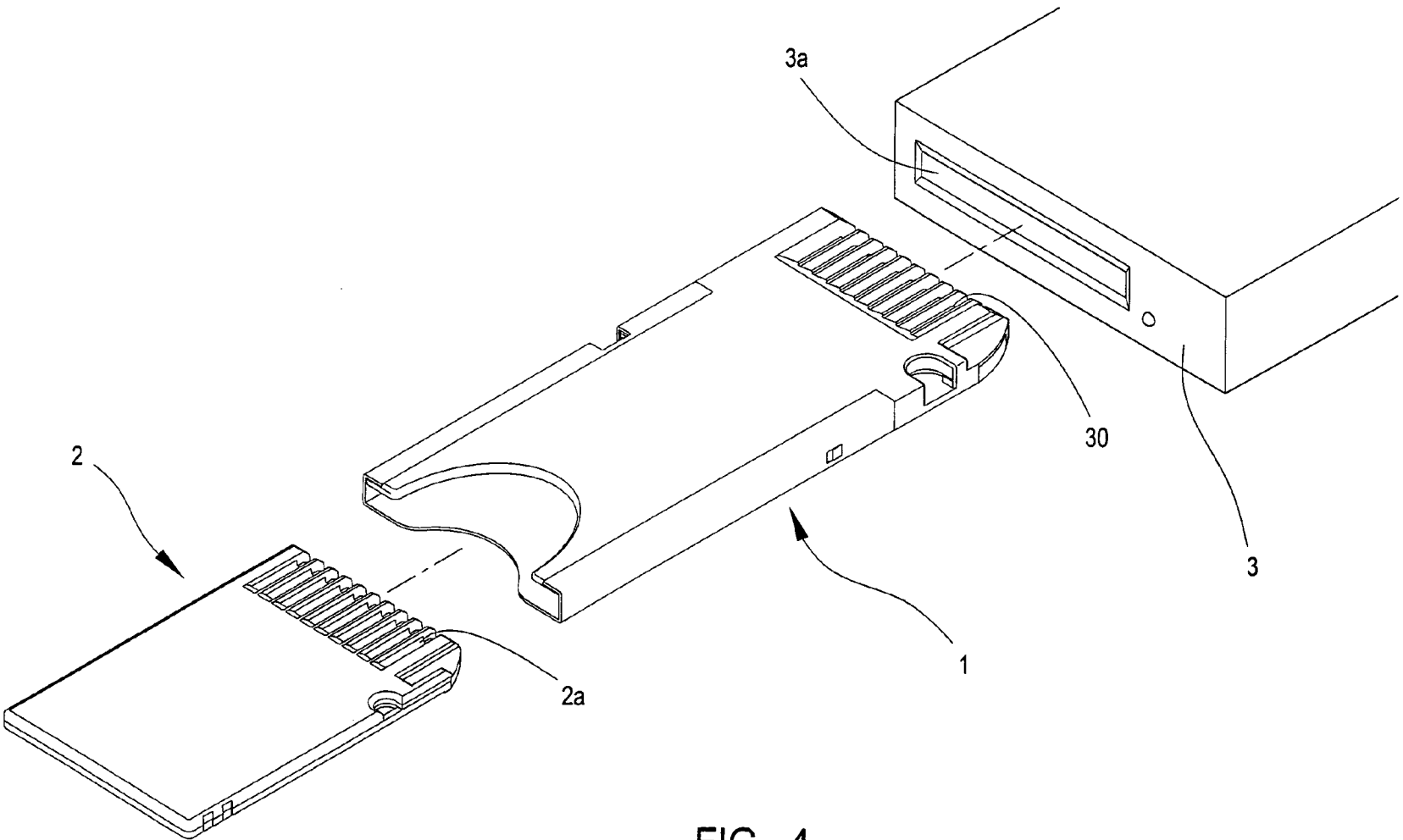
FIG. 4 shows a schematic view of implementation of the present invention.

Referring to FIG. 4, upon applying, an MS DUO card 2 is inserted into an adapter 1 of the present invention, such that a gold finger 2*a* of the MS DUO card 2 can be in contact with the terminal 30 inside the adapter 1, to constitute the status of an MS card, and then proceed data transmission via connecting the terminal 30 with a connecting port 3*a* of an electronic consumer product 3.

Accordingly, the present invention uses a terminal assembly frame to integrate the terminal with fixing structures, in order to achieve the purpose of easy assembly and maintenance, thereby lowering the manufacturing cost, and improving signal transmission due to direct connection.

It is of course to be understood that the embodiments described herein is merely illustrative of the principles of the invention and that a wide variety of modifications thereto may be effected by persons skilled in the art without departing from the spirit and scope of the invention as set forth in the following claims.

What is claimed is:

1. A memory card adaptor comprising:

a) a casing having:

i) an upper casing having a positioning column; and ii) a lower casing connected to the upper casing;

b) a terminal assembly frame located in the casing and having a plurality of terminal holes and a positioning hole, the positioning column of the upper casing aligning with and being inserted into the positioning hole of the terminal assembly frame; and c) a plurality of terminals, one of the plurality of terminals being inserted into each of the plurality of terminal holes, ends of the plurality of terminals extending outwardly from opposing sides of the terminal assembly frame.

2. The memory card adaptor according to claim 1, wherein the upper casing having a latching part extending outwardly from each of two sides thereof, the lower casing having a latch hole located in each of two sides thereof, and one latching part being inserted into each latch hole.

3. The memory card adaptor according to claim 2, wherein the lower casing having a front lid and a frame aligning with a front end of the upper casing, the front lid having a shape matching a shape of the front end of the upper casing.

4. The memory card adaptor according to claim 2, wherein the positioning hole is located on one end of the terminal assembly frame.

* * * * *